US005947178A

United States Patent [19]

Patten

[11] Patent Number: 5,947,178

[45] Date of Patent: Sep. 7, 1999

[54] MOVABLE COVER FOR A ROOF, POOL, OR OTHER OPENING

[75] Inventor: Roger W. Patten, Seattle, Wash.

[73] Assignee: Patten Partnership Ltd., Seattle, Wash.

[21] Appl. No.: 08/939,137

[22] Filed: Sep. 29, 1997

[51] Int. Cl.[6] ..... E05F 11/00

[52] U.S. Cl. ..... 160/193; 160/206

[58] Field of Search ..... 160/193, 201, 160/84.08, 84.06, 215, 35, 199, 84.04, 206; 114/201 R, 202; 4/498, 500

[56] References Cited

U.S. PATENT DOCUMENTS

| | | | |
|---|---|---|---|
| 834,287 | 10/1906 | Frey | 160/206 X |
| 935,431 | 9/1909 | Tackman . | |
| 2,990,556 | 7/1961 | Bender | 160/193 |
| 3,127,925 | 4/1964 | Sjostrom | 160/193 |
| 3,199,576 | 8/1965 | Jericijo . | |
| 3,333,621 | 8/1967 | Elder . | |
| 3,389,741 | 6/1968 | Bean . | |
| 3,415,260 | 12/1968 | Hall . | |
| 3,465,807 | 9/1969 | Beas | 160/193 |
| 3,683,428 | 8/1972 | Morris . | |
| 3,872,522 | 3/1975 | Bennett et al. . | |
| 4,038,788 | 8/1977 | Claessens . | |
| 4,577,352 | 3/1986 | Gautheron . | |
| 4,616,451 | 10/1986 | Glick . | |
| 4,742,653 | 5/1988 | Napier et al. . | |
| 4,829,726 | 5/1989 | de Potter d'Indoye . | |
| 5,067,182 | 11/1991 | Koelsch . | |
| 5,195,569 | 3/1993 | Peterson et al. | 160/84.06 |

FOREIGN PATENT DOCUMENTS

| | | | |
|---|---|---|---|
| 1074253 | 1/1960 | Germany | 160/193 |
| 282022 | 4/1952 | Switzerland | 160/193 |

*Primary Examiner*—Blair M. Johnson
*Attorney, Agent, or Firm*—Christensen, O'Connor, Johnson & Kindness PLLC

[57] ABSTRACT

A foldable cover of simple structure and light weight is provided. The cover consists of multiple cover sections which are connected by hinges so that they may be folded together. Each of the cover sections has a hole in its surface through which a cable extends, such that when the cable is pulled, the cover sections are folded together at one side of the opening. The cable is initially pulled from a height above the cover sections so that the first pair of cover sections are caused to buckle upwards and then fold together. Further pulling on the cable causes the remaining pairs of cover sections to buckle and fold one pair at a time. When the cover is being extended, a tension is maintained on the pulling cable so as to control the falling speed of the cover sections as they unfold. Hinges and wheels that are used on the cover and around the holes exhibit a low rotational friction, so that the cover may be opened and closed easily. A hand truck with a winch is used to pull the retracting cable so that the cover is folded on to the hand truck, whereby the cover can easily be moved to different locations. Cover sections of different sizes and shapes are used to make the cover as a whole a particular shape.

22 Claims, 5 Drawing Sheets

MOVABLE COVER FOR A ROOF, POOL, OR OTHER OPENING

FIELD OF THE INVENTION

The invention relates generally to covers for roofs or pools or, specifically, the invention relates to movable covers that can be folded or unfolded.

BACKGROUND OF THE INVENTION

Many types of covers for roofs, pools, or other openings have been developed in the past. These covers range from the very simple to the very complex. One simple type of foldable pool cover includes sections hinged together in such a way that they may be folded together in an accordion-like fashion so that the cover as a whole will fit into a small space when not in use. Examples of this simple type of foldable cover are shown in U.S. Pat. No. 3,683,428, issued to Morris, and U.S. Pat. No. 5,067,182, issued to Koelsch.

Most complex foldable covers often include a mechanism to allow a user of the cover to extend or retract all of the cover sections from a single stationary position. For example, cables attached to a first or last cover section and wound on a winch or other winding device can be used to extend or retract the cover sections. Exemplary examples of this type of retractable cover are shown in U.S. Pat. No. 935,431, issued to Tackman, and U.S. Pat. No. 3,199,576, issued to Jericijo.

Most prior covers that extend to a flat position and use cables require complex and expensive mechanisms for refolding the covers. They also often put (a substantial) strain on the pulling cables since they are sometimes required to support the weight of pulling up on all of the cover sections at once. For example, Tackman, with reference to FIG. 2, discloses a process for beginning the folding process by swinging a post outward at one end of the folding cover, so as to produce tension on a cover-tilting cable. The cable then rocks stanchions to an angle and draws on the connecting cables, the result of which is that the hatch sections are raised in a zigzag order. After the hatch cover sections are buckled upwards in this manner, an additional cable, which is attached to one of the end sections, is used to pull the cover sections toward one end until they are completely folded. Jericijo discloses retracting the cover sections through use of a wire, which runs through pulleys, which are attached near the hinge sections of the cover sections.

Covers such as those disclosed in Tackman and Jericijo require complex folding mechanisms such as special hinges, additional pulleys, and other special parts. They are expensive, difficult to use, and subject to breaking down due to the numerous parts that are required. The present invention is directed to a foldable cover that overcomes the foregoing and other disadvantages. More specifically, the present invention is directed to a foldable cover with a simple means for extension and retraction by a cable.

SUMMARY OF THE INVENTION

A foldable cover having a plurality of cover sections is disclosed. The cover sections are hingeably joined to one another. The cover may be extended across an opening and then retracted to a folded position at one side of the opening. The cover is retracted by a retracting cable, which when pulled causes the cover sections to fold together.

In accordance with one aspect of the invention, the retracting cable passes through holes through each of the surfaces of the cover sections. When the retracting cable is pulled from a position that is vertically displaced from the cover sections, it causes the first pair of cover sections to buckle upwards and then fold together. Further pulling on the cable causes the remaining pairs of cover sections to buckle and fold together one pair at a time. The initial vertical displacement from which the cable is pulled may be established by a winch or pulley that is mounted on a support at a suitable height. Once some of the cover sections are folded together, the cable is then pulled from a height equal to the height of the holes in the surfaces of the folded cover sections. This configuration simplifies the foldable cover as compared to covers which use complex buckling, folding, and cable pulling mechanisms, which are expensive, subject to breaking down, and often put substantial strain on the cables when they are required to buckle and pull all of the cover sections at one time.

In accordance with another aspect of the invention, the holes in the cover sections may be elongate or have pulleys (see FIG. 6). Further, the holes in the central cover sections may be extended to the edges where the cover sections meet so that the retracting cable lies in a slot that is formed when the cover is flat. Pulleys may also be included in or near the holes to further assist the pulling of the cable.

In accordance with another aspect of the invention, tension is maintained on the retracting cable when the foldable cover is being extended. This feature controls the speed at which the cover sections unfold. Without this control, the force of gravity could cause the cover sections to fall very quickly, which in some arrangements could damage the cover sections and put a large amount of stress on the hinges between the cover sections.

In the preferred embodiments of the invention, wheels and hinges that exhibit low rotational friction are used on the cover sections so that the weight of the cover sections is the primary force for causing the cover sections to unfold and extend. In this manner, little or no pulling force at the end of the cover is required to extend the cover.

In accordance with another aspect of the invention, a hand truck equipped with a winch is provided at one end of the cover. The winch operates to pull the retracting cable so that the cover is folded onto hand truck. The folded cover can then be moved to different locations by moving the hand truck.

In accordance with another aspect of the invention, the cover sections may be of different sizes and shapes so that the deployed cover corresponds to a desired shape and size. For example, rectangular cover sections can be used to form a simple rectangular cover. Trapezoidal cover sections can be used to form a rounded fan-shaped cover. Also, multiple covers may be used in conjunction with one another to cover different parts of an opening.

It will be appreciated that the disclosed foldable cover is advantageous and that it is made of a simpler structure than prior foldable covers, and is therefore lighter, less expensive, and less subject to breaking down.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
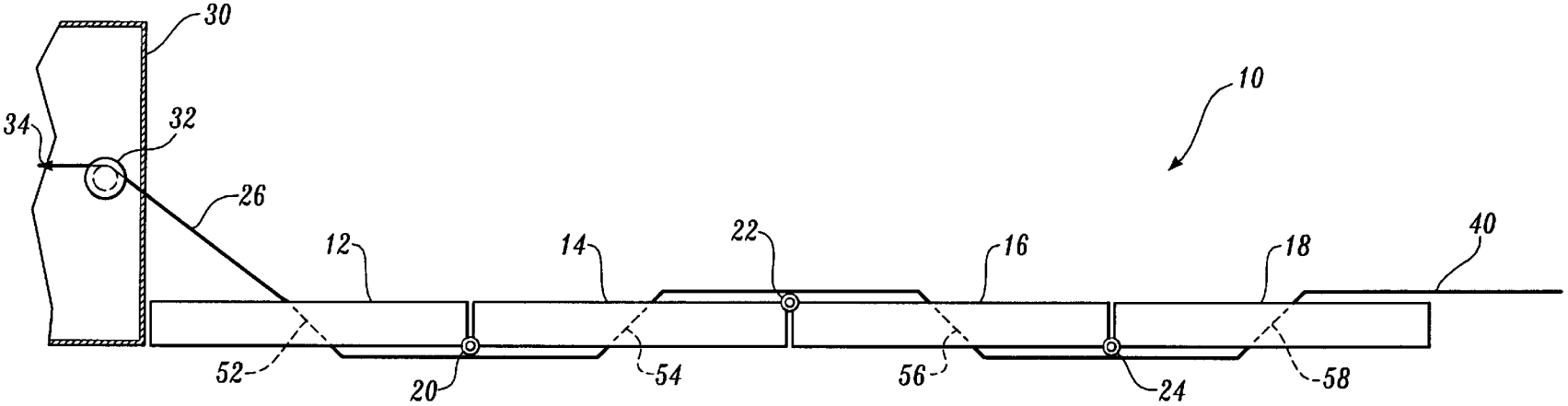
FIG. 1 is a side view of the foldable cover formed in accordance with the present invention with the cover sections in a fully extended flat position.
Figure 2:
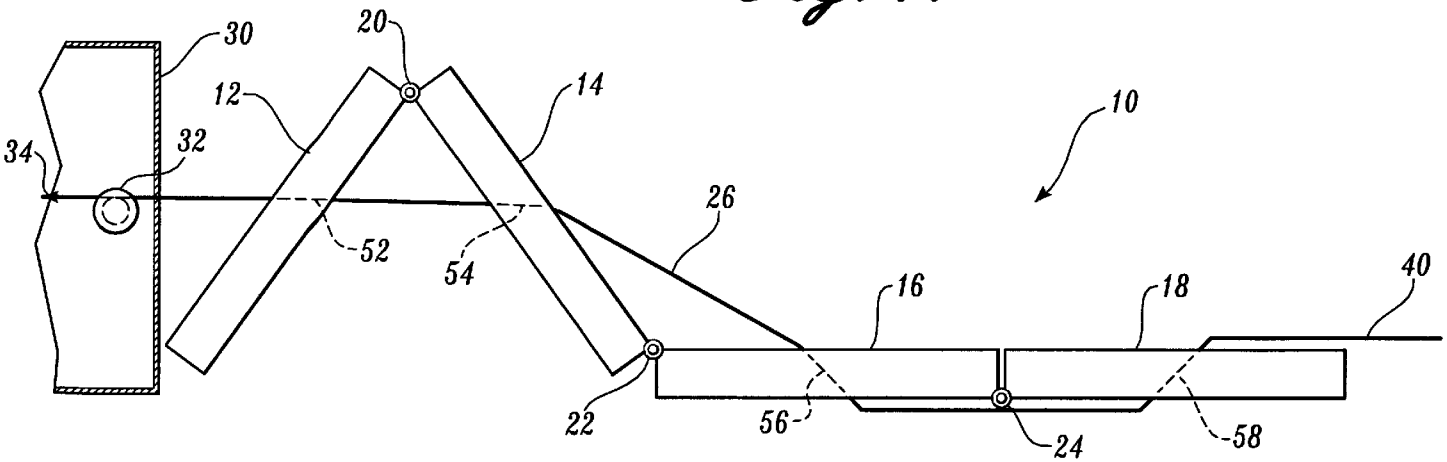
FIG. 2 is a side view of the foldable cover of FIG. 1 with the first and second cover sections in a partially folded position.
Figure 3:
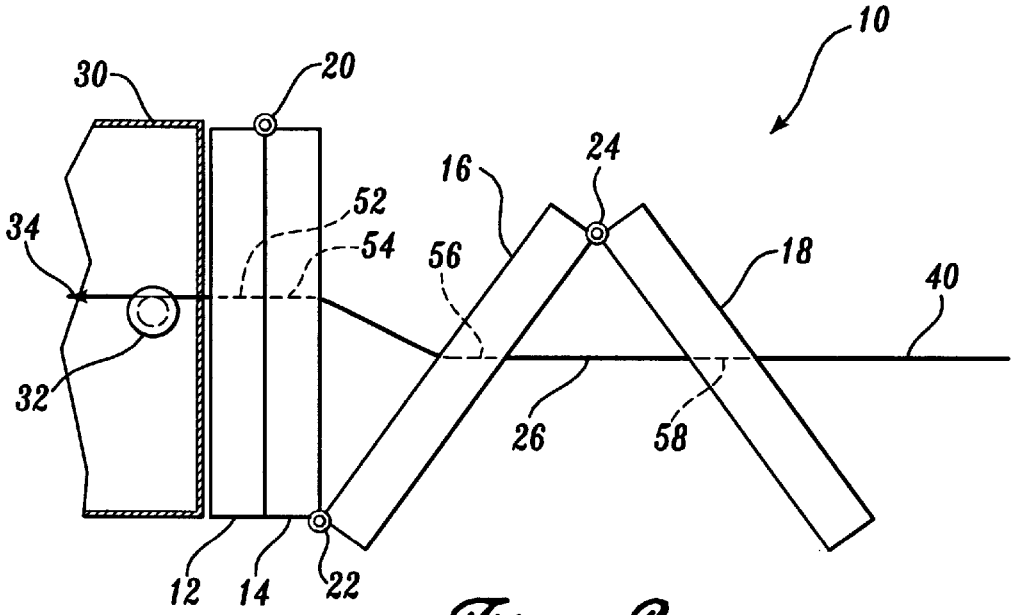
FIG. 3 is a side view of the foldable cover of FIG. 1 with the first and second covers fully folded and the third and fourth cover sections in a partially folded position.
Figure 4:
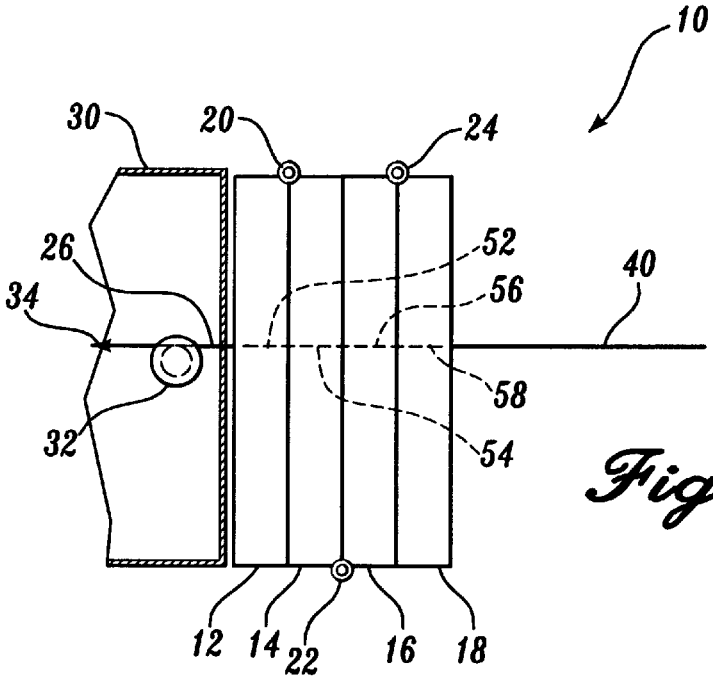
FIG. 4 is a side view of the foldable cover of FIG. 1 with all of the cover sections in a fully folded position.

A foldable cover 10 formed in accordance with the present invention is illustrated in FIG. 1. The overall operation of the foldable cover 10 is first discussed generally below and then the individual structure and operation of the cover is discussed in more detail. The foldable cover 10 is designed for use as a cover for a swimming pool, or as a retractable roof, and for use in other situations in which a cover is needed. The cover is shown in its fully extended position in FIG. 1. When the cover is to be retracted, a cable 26 is pulled by a pulley or winch 32 at a level that is vertically displaced from the fully extended cover 10. As shown in FIGS. 2 and 3, the winding in of the cable 26 causes the cover sections of the foldable cover 10 to fold inward. FIG. 4 shows the foldable cover 10 in a fully folded position. Once in its fully folded position, in relatively small embodiments of the invention the foldable cover 10 may be transported to a new location through use of a means such as a hand truck or other device.

Figure 5:
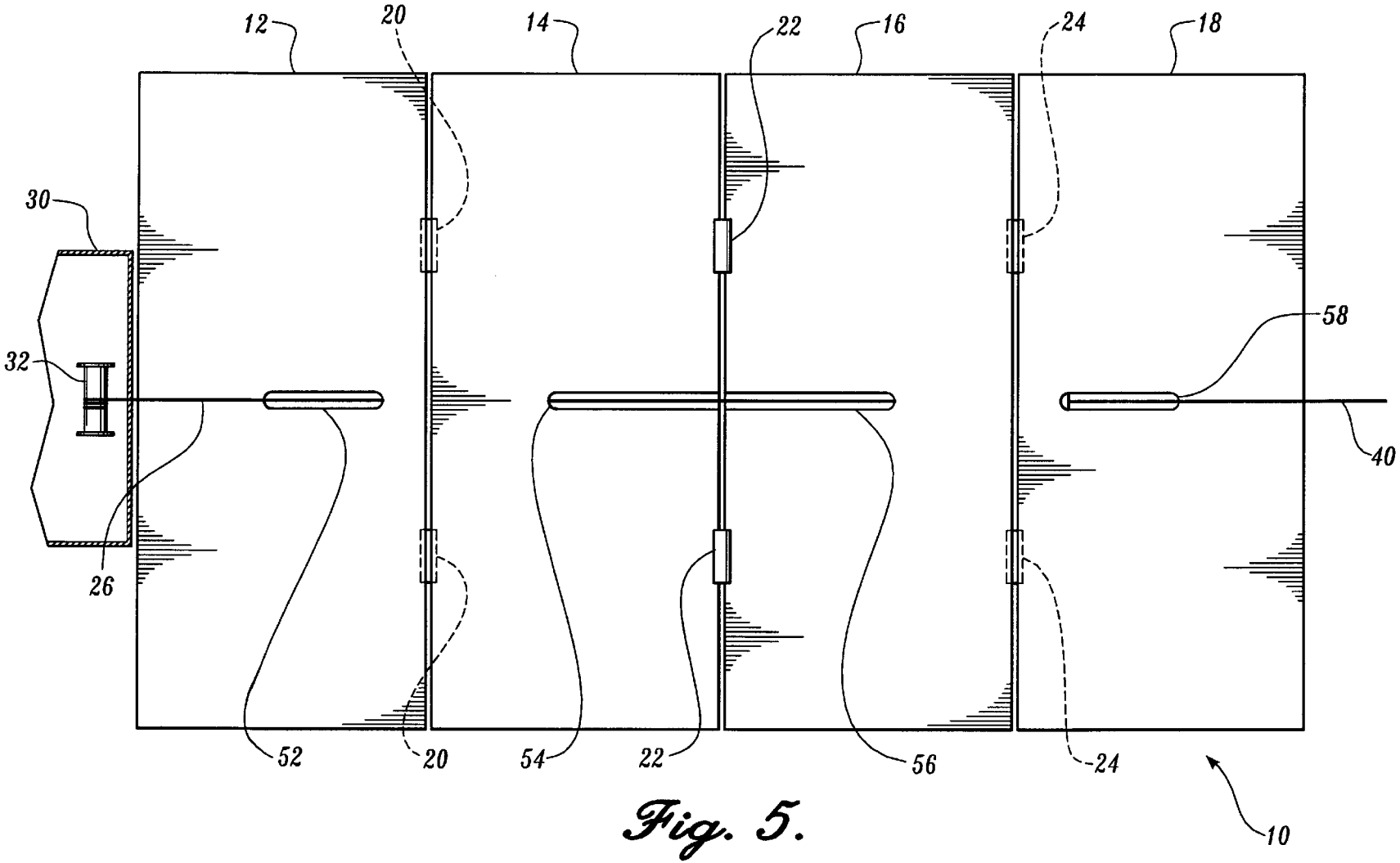
FIG. 5 is a top view of the foldable cover of FIG. 1 with the cover sections in a fully extended flat position.

The individual parts and operation of the foldable cover 10 will now be described in more detail. The foldable cover 10 includes four separate cover sections 12, 14, 16, and 18. In the embodiment shown in FIG. 1, the cover sections lie flat adjacent to each other so as to form a roof or other cover. In one embodiment the cover sections are rigid rectangular members, as illustrated in FIG. 5.

The cover sections are connected along their edges by hinges 20, 22, and 24. As shown in FIGS. 1 and 5, a pair of spaced-apart hinges 20 connect cover sections 12 and 14 at their bottom edges; a pair of spaced-apart hinges 22 connect cover sections 14 and 16 at their top edges; and a pair of spaced-apart hinges 24 connect cover sections 16 and 18 at their bottom edges. Thus, as the cover is folded inward, as illustrated in FIGS. 2 and 3, hinges 20 and 24 move upwards, while hinges 22 remain at the bottom.

The cover sections are also connected to one another by a tension cable 26 that extends and slides through a hole in the center of each cover section. As illustrated in FIG. 5, holes 52, 54, 56, and 58 are disposed in cover sections 12, 14, 16, and 18, respectively. Holes 54 and 56 in cover sections 14 and 16 can be elongate slots that extend to the edges where the cover sections are hinged together so as to form a slot in which the cable 26 may lie when the cover 10 is flat. Holes 52 and 58 can also be elongate and may extend towards the hinges 20 and 24, respectively. In general, the holes 52, 54, 56, and 58 may be shaped and positioned in a manner that allows the cable 26 to slide through the holes and perform the functions described below. As illustrated in FIG. 1, cable 26 runs down through hole 52 in cover section 12, underneath cover sections 12 and 14, up through hole 54 in cover section 14, across the tops of cover sections 14 and 16, down through hole 56 in cover section 16, beneath cover sections 16 and 18, and back up through hole 58 in cover section 18. One end of cable 26 is attached through the hole 58 in cover section 18 by means of a knot or other means that stops cable 26 from sliding through hole 58. The other end of cable 26 extends upwardly at approximately a 45° angle from cover section 12 (when cover section 12 is in the fully extended position) and through a hole in support 30 and onto a winch 32.

The retraction of the foldable cover 10 through use of the cable 26 works in the following manner. From the position illustrated in FIG. 1, as the cable 26 is wound in the direction of arrow 34, it produces a vertical lifting force on the cover section 12 at the hole 52. This vertical force causes the cover sections 12 and 14 to buckle upwards at the hinges 20, as illustrated in FIG. 2. Slightly elongating the holes 52 and 54 toward the hinges 20 may assist this buckling process. Once cover sections 12 and 14 are buckled upwards, the continuing retraction of cable 26 in the direction of arrow 34 causes cover sections 12 and 14 to be further folded inward as cover sections 16 and 18 are pulled toward support 30 by the horizontal component of the force exerted by cable 26, thus pushing the lower edge of cover section 14 at hinges 22 further inward. Once cover sections 12 and 14 are fully folded, as illustrated in FIG. 3, cable 26 initially forms a 45° angle from the hole 54 in cover section 14 to the hole 56 in cover section 16. Thus, similar to the way in which cover sections 12 and 14 were initially buckled upwards, further retraction of the cable 26 in the direction of arrow 34 now buckles cover sections 16 and 18 upwards at hinges 24 as shown in FIG. 3. The continuing retraction of cable 26 further causes cover sections 16 and 18 to fold inward as the cable 26, which is attached through the hole 58 in cover section 18, pulls cover section 18 toward support 30. The fully folded position of the foldable cover 10 is illustrated in FIG. 4.

During the extension of the foldable cover 10, the cable 40, which may either be a separate cable or an extension of the cable 26, is attached to the cover section 18 and is pulled outwards. As the cover sections 16 and 18 go from the position in FIG. 4 to the position shown in FIG. 3, a tension is maintained on the cable 26 so as to control the falling speed of the cover sections 16 and 18. Without this control, the force of gravity could cause cover sections 16 and 18 to fall quickly, which could damage the cover sections and put a large amount of stress on the hinges 24. Once cover sections 16 and 18 have filly extended downward as illustrated in FIG. 2, continuing force on cable 40 causes cover sections 12 and 14 to fold outward according to the pull exerted on the lower portion of cover section 14 at hinges 22 by the outward movement of cover sections 16 and 18. Again, cable 26 is maintained with a continuing tension so as to control the falling speed of cover sections 12 and 14. The fully extended position of the foldable cover 10 is illustrated in FIG. 1.

Figure 6:
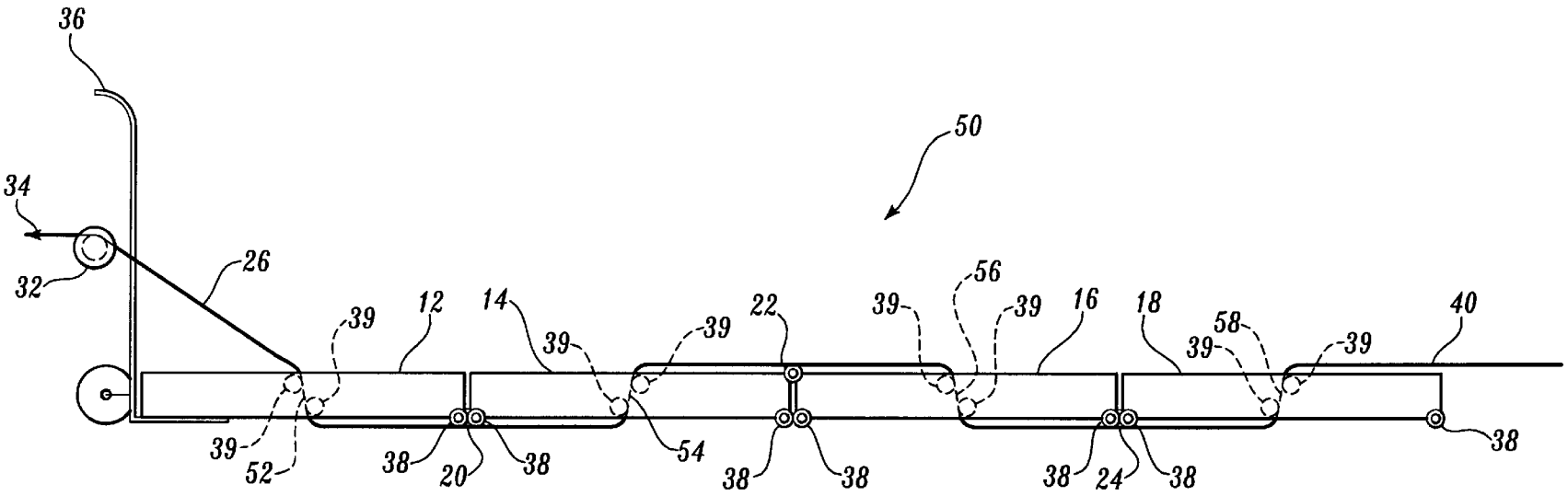
FIG. 6 is an alternate embodiment of the foldable cover of FIG. 1, including pulleys, wheels, and a hand truck.

An alternate embodiment of the foldable cover of the present invention is shown in FIG. 6. As illustrated in FIG. 6, a foldable cover 50 includes similar components to the foldable cover 10 but also includes some additional components such as pulleys, wheels, and a hand truck. As illustrated in FIG. 6, the edges of cover sections 12, 14, 16, and 18 are fitted with wheels or rollers 38 so as to aid in the extension and retraction of the foldable cover 50. The wheels 38 and also the hinges 20, 22, and 24 may be of a type that are selected based on the desired ease or difficulty with which the foldable cover 50 is to be extended or retracted. Wheels and hinges that are more difficult to rotate will require greater force on cable 40 to extend the cover 50, but less tension on cable 26 to prevent the rapid falling of the cover sections. On the other hand, wheels and hinges that rotate more easily will require less force on cable 40 but greater tension on cable 26. In one embodiment, the wheels 38 and hinges 20, 22, and 24 may be of the type that are very easily rotated, so that the weight of the cover sections themselves may be sufficient for causing the cover sections to extend outwards with little or no pulling required on cable 40. Thus, in some embodiments, cable 40 may be eliminated.

The first cover section 12 of the foldable cover 50 is hingeably attached to a hand truck 36, which includes a motorized winch that is positioned so that it winds or unwinds the cable 26 from a proper height; for example, a height where, when the first cover section 12 is in the fully extended flat position, the cable 26 forms approximately a 45° angle with the back of the hand truck 36 (i.e., with the vertical). A similar 45° angle can be achieved by routing the cable 26 through a pulley mounted on a post at a suitable height above the cover sections. Once the cable is wound in, the folded cover 50 can be moved to different locations on the hand truck 36.

Pulleys or cable-guiding devices 39 are attached in or near the holes 52, 54, 56, and 58 of the cover sections of the foldable cover 50. Pulleys or cable-guiding devices 39 act to reduce the friction and wear on the cable 26 as it is pulled through the holes and further assist with the lifting of the cover sections.

The foldable cover of the present invention reduces or eliminates a number of the problems associated with the prior foldable covers. Foldable covers 10 and 50 are specially designed to eliminate the need for additional parts and complex mechanisms to buckle the cover sections upward from their flat position so that they can be folded inward. The special design includes the use of holes through the center of each of the cover sections, in combination with the pulling of the cable 26 from a height above the initially flattened cover sections.

The configuration of the present invention also reduces the strain placed on the pulling cable 26 and the winch motor 32. Because only one pair of cover sections is buckled upwards at a time, tension in the cable and work done by the winch 32 for buckling the cover sections is limited to the load created by two cover sections at a time.

For the extension of the foldable covers 10 and 50, the maintaining of tension on the pulling cable 26 allows for the smooth lowering of the pairs of cover sections. Because the cover sections are lowered at a controlled speed, the danger of damage to the cable, cover sections, and/or hinges, due to the weight of the falling cover sections, is eliminated. In addition, the smooth controlled falling speed allows the use of hinges that allow the cover sections to lower easily with little or no pulling required on an outer cable 40.

Also, the present invention is arranged so that it can be easily moved on a hand truck or similar device. The foldable cover can also be extended out onto any surface without the need for specially configured sections in the ground or other structure that lies beneath the cover and without the need for special rails for assisting the rolling out of the cover sections. In addition, this simpler construction reduces the weight of the cover, which allows the cover to be more easily moved, and allows the cover to be opened and closed faster.

Figure 7:
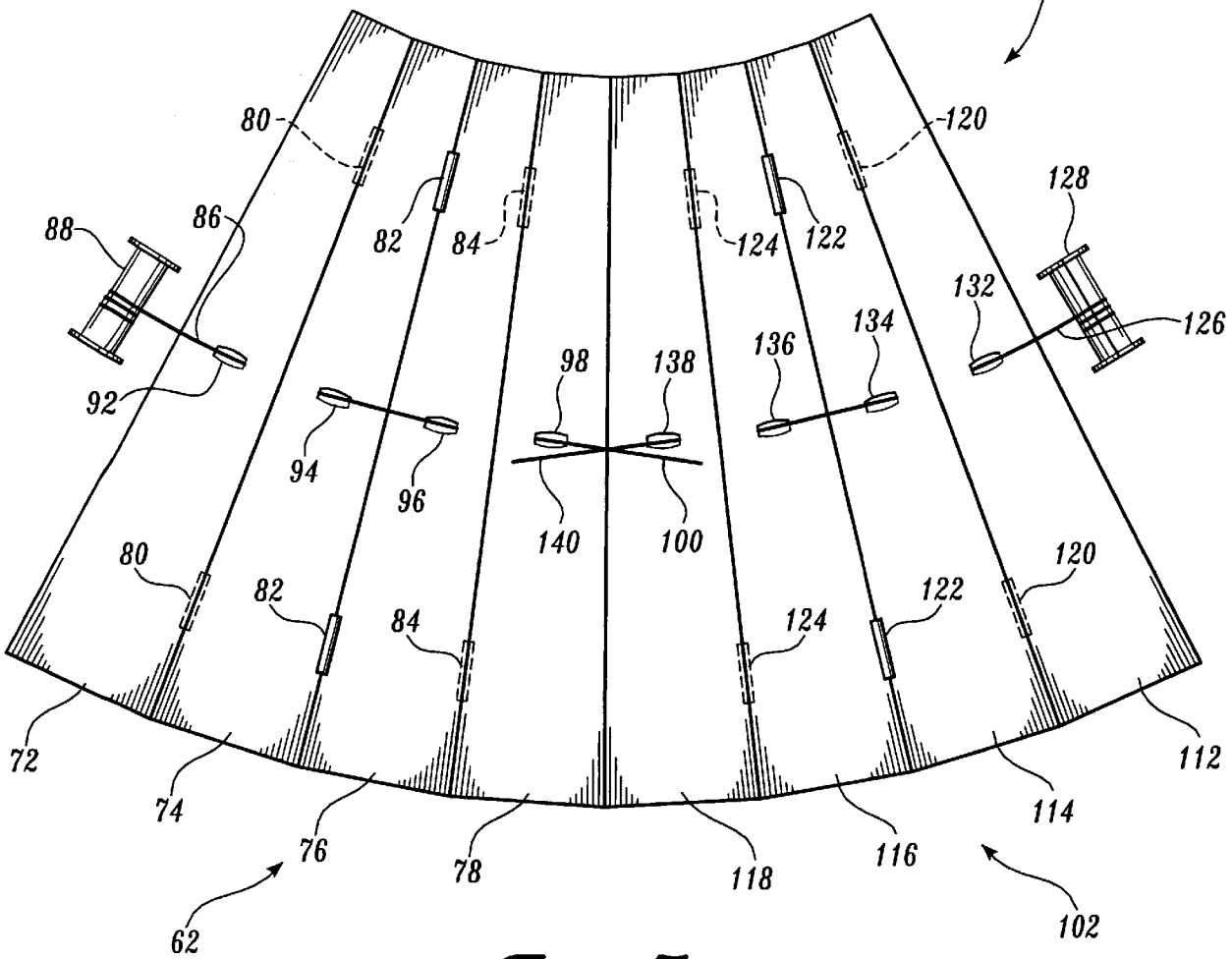
FIG. 7 is a top view of an alternate embodiment of a foldable cover formed in a fan-shaped structure in accordance with the present invention.

Another alternate embodiment of the foldable cover of the present invention is shown in FIG. 7. As illustrated in FIG. 7, folding cover 60 formed in accordance with the present invention includes two separate foldable covers 62 and 102. Each foldable cover 62 and 102 spans approximately one-half the opening covered by the cover 60. Foldable cover 62 includes four foldable cover sections 72, 74, 76, and 78, while foldable cover 102 includes four foldable cover sections 112, 114, 116, and 118. As illustrated in FIG. 7, the cover sections may be generally trapezoidal in shape, such that the covers as a whole form a rounded fan shape.

Similar to the way in which the cover sections 12, 14, 16, and 18 were joined as described previously, cover sections 72, 74, 76, and 78 are joined by hinges 80, 82, and 84, while cover sections 112, 114, 116, and 118 are joined by hinges 120, 122, and 124. Hinges 80 join the lower edges of cover sections 72 and 74, hinges 82 join the upper edges of cover sections 74 and 76, and hinges 84 join the lower edges of cover sections 76 and 78. Hinges 120 join the lower edges of cover sections 112 and 114, hinges 122 join the upper edges of cover sections 114 and 116, and hinges 124 join the lower edges of cover sections 116 and 118.

A pulling cable 86 runs through holes 92, 94, 96, and 98 in the centers of cover sections 72, 74, 76, and 78, respectively. A pulling cable 126 runs through holes 132, 134, 136, and 138 in the centers of cover sections 112, 114, 116, and 118, respectively.

Covers 62 and 102 are folded and extended in a manner similar to cover 10. Thus, covers 62 and 102 each have a pulley or winch (88 and 128) at the edge of the cover that retracts the cable 86 or 126, respectively, when the covers are to be folded. In addition, extending cables 100 and 140, which may be separate cables or extensions of the cables 86 and 126, respectively, may be pulled to extend the covers 62 and 102 to their fully extended positions as illustrated in FIG. 7.

While the preferred embodiment of the invention has been illustrated and described, it will be appreciated that various changes can be made therein without departing from the spirit and scope of the invention. For example, rather than using a single cable through a set of holes in a foldable cover, multiple cables through multiple sets of holes could be used to extend and fold the cover.

The embodiments of the invention in which an exclusive property or privilege is claimed are defined as follows:

1. A foldable cover that can be extended across an opening, the foldable cover comprising:

a plurality of cover sections, said plurality of cover sections defining a substantially horizontal plane when extended across said opening each cover section having a surface for covering part of the opening and an aperture extending through the surface of the cover section, each cover section also having an edge that is positioned adjacent to and is hinged together with an edge of another one of the cover sections;

a pulling cable having two ends, the pulling cable extending through the apertures in the surfaces of the cover sections, the pulling cable being fixed at one end of the foldable cover such that when the other end of the pulling cable is pulled, the cover sections are folded together; a cable pulling structure, wherein at least part of the pulling cable is pulled toward a height that is vertically displaced from said plane.

2. The foldable cover of claim 1, wherein the height from which the pulling cable is pulled causes the pulling cable to make an angle of approximately 45° with the opening across which the foldable cover is extended.

3. The foldable cover of claim 1, wherein at least one of the apertures through one of the cover sections is elongated.

4. The foldable cover of claim 1, wherein at least one of the cover sections includes a slot in which the pulling cable may lie when the foldable cover is extended.

5. The foldable cover of claim 1, wherein when the pulling cable is pulled, only two cover sections are caused to be buckled upwards at any one time.

6. The foldable cover of claim 1, wherein each cover section has at least one top edge and one bottom edge, the hinged-together edges of the cover sections alternating between adjacent top edges and adjacent bottom edges across the foldable cover.

7. The foldable cover of claim 1, wherein the hinges between the cover sections rotate with a friction that is low enough so that the cover is extendible primarily by the weight of the cover sections.

8. The foldable cover of claim 7, further comprising means for maintaining a tension on the pulling cable while the foldable cover is being extended.

9. The foldable cover of claim 1, further comprising wheels on the cover sections to assist with the extension and folding of the foldable cover.

10. The foldable cover of claim 1, wherein the cover sections are generally rectangular in shape.

11. The foldable cover of claim 1, wherein the cover sections are generally trapezoidal in shape.

12. The foldable cover of claim 1, wherein said cable pulling structure comprises a hand truck with a winch, the winch being operated to pull the pulling cable so as to fold the cover sections together onto the hand truck, the folded cover thereby being maneuverable on the hand truck to different locations.

13. The foldable cover of claim 1, further comprising at least one cable guide attached to at least one of the cover sections for helping to guide the pulling cable through the aperture in the cover section.

14. The foldable cover of claim 13, wherein the cable guide comprises a pair of pulleys located on either side of the aperture.

15. A foldable cover that can be extended across an opening, the foldable cover comprising:

a plurality of pairs of first and second cover sections, said plurality of cover sections defining a substantially horizontal plane when extended across said opening the cover sections of each pair being connected to one another by hinges, each pair of cover sections having a folded and unfolded position and being connected by a hinge to at least one other pair of cover sections, the foldable cover being extended when the pairs of cover sections are unfolded and being retracted when the cover sections are folded;

each of the pairs of first and second cover sections having surfaces for covering part of the opening and an aperture extending through each of the surfaces of the first and second cover sections, the apertures being approximately aligned with one another when the pairs of cover sections are in the folded position; and a cable for retracting the foldable cover, the cable extending through the apertures in the surfaces of each of the pairs of first and second cover sections; a cable pulling structure, wherein at least part of the pulling cable is pulled toward a height that is vertically displaced from said plane.

16. The foldable cover of claim 15, further comprising at least one cable guide attached to at least one of the cover sections for helping to guide the cable through the aperture in the cover section.

17. The foldable cover of claim 16, wherein the cable guide comprises a pair of pulleys located on either side of the aperture.

18. The foldable cover of claim 15, wherein each of the cover sections have lower and upper edges, each of the first and second cover sections in each pair being hinged together at their lower edges, and each pair being hinged to the adjacent pair at the upper edges of the adjacent cover sections.

19. The foldable cover of claim 15, wherein when the cable retracts the foldable cover, each pair of cover sections is caused to be folded into its folded position one pair at a time.

20. A foldable cover having extended and retracted positions, the foldable cover comprising:

first, second, third, and fourth cover sections; each cover section having a surface for covering part of an opening and an aperture extending through the surface of each of the cover sections said cover sections defining a substantially horizontal plane when extended across said opening;

the first and second, second and third, and third and fourth cover sections being hingeably joined to one another;

a cable for retracting the foldable cover to the retracted position, the cable passing through the aperture in the surface of each of the cover sections such that when the cable is pulled from a position that is vertically displaced from the cover sections, the first and second cover sections are first caused to buckle upwards and fold together, after which further pulling on the cable causes the third and fourth cover sections to buckle upwards and fold together; a cable pulling structure, wherein at least part of the pulling cable is pulled toward a height that is vertically displaced from said plane.

21. The foldable cover of claim 20, wherein said cable pulling structure comprises a hand truck and a winch, the first cover section being hingeably attached to the hand truck, the winch being operated to retract the cable so as to retract the foldable cover on to the hand truck so that the foldable cover is thereby maneuverable to different locations on the hand truck.

22. The foldable cover of claim 20, wherein two or more foldable covers are configured for covering predetermined portions of an opening with the two or more covers being extendible to collectively cover the opening.

* * * * *